United States Patent [19]

Wenzel

[11] 4,248,701

[45] Feb. 3, 1981

[54] SIDE SEAL ASSEMBLY FOR A SCREENING MACHINE

[75] Inventor: Theo Wenzel, Egmating, Fed. Rep. of Germany

[73] Assignee: Hein, Lehmann AG, Dusseldorf, Fed. Rep. of Germany

[21] Appl. No.: 25,431

[22] Filed: Mar. 30, 1979

[30] Foreign Application Priority Data

Mar. 30, 1978 [DE] Fed. Rep. of Germany ..... 2813630

[51] Int. Cl.[3] ..... B07B 1/46

[52] U.S. Cl. ..... 209/363; 209/396; 209/310; 277/DIG. 6

[58] Field of Search ..... 209/403, 405, 408, 310, 209/396, 363, 364; 277/DIG. 6; 210/488, 489

[56] References Cited

U.S. PATENT DOCUMENTS

| | | | |
|---|---|---|---|
| 1,725,511 | 8/1929 | Flanagan | 209/403 X |
| 2,114,406 | 4/1938 | Simpson | 209/403 |
| 2,230,321 | 2/1941 | Downs | 209/405 |
| 2,338,904 | 1/1944 | Cowles | 210/389 X |
| 2,648,441 | 8/1953 | Soldan | 209/403 X |
| 3,148,888 | 9/1964 | Clark | 277/DIG. 6 |
| 3,363,769 | 1/1968 | Wilmot | 209/405 X |
| 3,653,675 | 4/1972 | Schaefer | 277/DIG. 6 |
| 3,928,189 | 12/1975 | Lowel | 209/405 |
| 3,970,322 | 7/1976 | Stecher | 277/DIG. 6 |
| 3,971,715 | 7/1976 | Wehner | 209/396 X |
| 4,064,051 | 12/1977 | Wehner | 209/310 |
| 4,165,085 | 8/1979 | Persson | 277/DIG. 6 |

FOREIGN PATENT DOCUMENTS

| | | | |
|---|---|---|---|
| 2108924 | 9/1972 | Fed. Rep. of Germany | 209/310 |
| 4824814 | 8/1970 | Japan | 277/DIG. 6 |
| 338651 | 11/1930 | United Kingdom | 209/403 |
| 383930 | 8/1973 | U.S.S.R. | 277/DIG. 6 |

*Primary Examiner*—Robert Halper

*Attorney, Agent, or Firm*—Allison C. Collard; Thomas M. Galgano

[57] ABSTRACT

A side seal assembly for a screening machine of the type which includes an elastic sealing element which bridges a slot between the sidewall and the screening lining of the screening machine, and a support for the sealing element is provided. The sealing element is covered with an elastic foam plastic at least at the side thereof facing the screening lining, and that the support for the sealing element is rigidly coupled with the sidewall of the screening machine.

11 Claims, 4 Drawing Figures

SIDE SEAL ASSEMBLY FOR A SCREENING MACHINE

The invention relates to a side seal assembly for a screening machine. More particularly, it relates to such an assembly which comprises an elastic sealing element which bridges a slot between the sidewall and the screening lining of the screening machine and a support which holds the sealing element in place.

Such a side seal assembly prevents stray granules from slipping into the slot between the sidewall and the screening element, bottom or lining. Difficulties exist in providing side seals for screening machines wherein the sidewalls and the screening lining move relative with respect to each other, for example, in "cocking lever shaft" or "crankshaft" screening machines. As is generally known, screening mechanisms of this type have the following essential features:

1. Adjacent strip-like screening mats or sieve bottoms which are mounted between grate rods along their longitudinal edges;

2. The grate rods are associated with two or more frame systems whereby each grate rod of one frame system is disposed between two grate rods of another frame system; and 3. The grate rods of the frame systems are respectively moved so that the screening mats form a sieve zone of continuously changing width, which form alternating and differently-shaped deep sagging when in a relaxed condition and which are also subjected to a different tension when in a taut position, so that they may assume an arc-like bulge.

In order to prevent stray granules from slipping through the slot between the screening lining or bottom and the sidewall, it is known to provide the screening lining with elastic sealing elements along its longitudinal edges (see German laid open Pat. No. 21,08,924). The sealing element is a wave-shaped rib which is rigidly coupled with the screening lining and is retained in a perpendicular position relative to the lining by means of supports. An overhanging sheet metal guide is provided on the sidewall of the screening machine which, in the installed position, engages over the wave-shaped rib in the form of a labyrinth seal.

Such a side seal wears out more rapidly than the screening lining because of the relative movement between the screening lining and the sidewall. Furthermore, the labyrinth seal must be exactly installed so as to be effective. Therefore, the installation is relatively expensive. This expense and the high material costs render the screening machine and its operation too expensive.

It is therefore an object of the instant invention to provide an effective and protective side seal for a screening machine, and, in particular, for a screening machine wherein the sidewalls and the screening lining move relative to one another.

It is also an object of the instant invention to provide a sidewall seal which can be made inexpensively, can be easily installed, and which also has a long life span.

The objects of the instant invention are obtained by the provision of a sealing element which is covered with an elastic foam plastic at least on its side facing the screening lining, and a support for the sealing element which is rigidly coupled with the sidewall of the screening machine. Consequently, the sealing element is not rigidly coupled with the screening lining, but only rests thereon. As a result, it does not appreciably hinder the movement of the lining.

Furthermore, it is easy to replace the screening lining or parts thereof without any hindrance by the sealing element. Also, the installation and dismantling of the sealing element is easily achieved. A particularly effective and easy installation of the sidewall sealing assembly is characterized in that the medium installation height of a bar of the support and the screening lining is between 3% and 20%, and preferably 5% and 15%, less than the medium installation height of the sealing element, and that the bar is provided with a groove-like, or channel-like recess, or forms a common channel with the sidewall into which the sealing element is clamped, due to its inherent resiliency or tension. This permits an automatic readjustment of the sealing element, so as to accommodate wear. Advantageously, the sealing element consists completely of elastic foam plastic; preferably, polyethylene.

To seal the sides of screening machines which operate in accordance with the "cocking lever shaft" or "crankshaft" principle, is particularly problematic because the slot between the sidewalls and the screening lining assumes a constantly changing shape and dimension, because relatively large and rapid relative movements occur. A side sealing element which meets all the requirements is rectangular in its cross-section and has a wave-shaped sealing face, facing the screening lining, the wave troughs or valleys of which are always positioned in the range of the transverse elements or cross rods to which the screening mats are mounted, so as to form the screening lining. However, if so desired, the cross-section of the sealing element may be oval, round or polygonally shaped. It is particularly advantageous if the sealing face which faces the screening lining, runs in a longitudinal direction in a sinusoidal manner.

Usually, the screen mats of the screening lining do not quite extend to the sidewall of the screening machine, but leave a slot of about 1 cm. In such cases, it has been shown to be advantageous to make the width of the sealing face of the sealing element about equal to the width of the opposing projection or engagement face on the edge of a screening mat of the screening lining, or to provide the sealing element with a groove which runs longitudinally along the screening lining. As a result, the sealing face of the sealing element does not extend beyond the edge of the screening lining and the screening lining is therefore not subjected to stress at its edge zones or borders.

When wet materials or goods are screened, it is especially advantageous that the sealing element consists of a foam plastic with closed pores. When screening wet goods, it is also advantageous that the sealing element be at least partially covered with a pore-closing layer and/or is provided with a pore-closing intermediate layer.

Other objects and features of the present invention will become apparent from the following detailed description considered in connection with the accompanying drawings, which disclose the several embodiments of the invention. It is to be understood, however, that the drawings are designed for the purpose of illustration only and not as a definition of the limits of the invention.

In the drawings, wherein similar reference characters denote similar elements throughout the several views.

Figure 1:
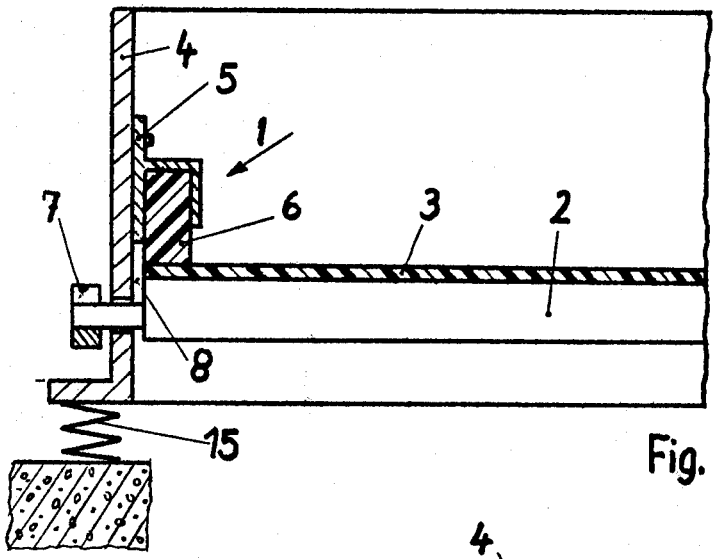
FIG. 1 is a fragmentarily-illustrated sectional view of a screening machine in which the inventive sidewall sealing element is shown in an installed position.

Referring now in detail in the drawings, FIG. 1 illustrates a sectional view of the inventive sidewall sealing element or assembly 1 in an installed position. The sidewall sealing element 1 is for a screening machine which operates in accordance with the so-called "cocking lever shaft" or "crankshaft" principle. The screening machine is provided with a screening lining which, in principle, has a rectangular outline, or face. The screening element is composed of screening mats 3, which are supported by transverse- or laterally-extending elements, or cross rods 2. The sidewalls of the screening machine encompass or surround the screening lining. The screening machine may be mounted with resilient or elastically-yielding elements 15 on a foundation or frame. The cross rods may be provided with drive elements 7, for effecting oscillating movement thereof. The side sealing element 1 is mounted on sidewalls 4 of the screening machine transversely or in a perpendicular direction with respect to cross rods 2. For this purpose, a clamping bar 5 is rigidly mounted on sidewall 4, in which sealing element 6 is secured, the former being screwed on or welded on. Bar 5 has a channel- or groove-like recess for receiving sealing element 6, which is securely clamped therein due to its inherent resiliency. The given or predetermined medium installation height defined between bar 5 (as measured from the base of the recess or channel thereof) and the screening lining is about 10% less than the medium installation height of sealing element 6. Thereby, sealing element 6 engages screening mats 3 with constant force or pressure, thus sealing the slot 8 between sidewall 4 and the screening lining. The medium installation height is to be understood to mean the medium or average between the largest and smallest installation height or distance between the horizontally-extending wall portion of bar 5 and the screening lining, which may vary due to the movement and the surface structure of the screening lining. The medium construction height of the sealing element is the average or medium between its largest and smallest construction height, for example, with sealing elements having a wave-shaped sealing face. During the operation of the screening machine, the sealing element automatically adjusts to the slot, which constantly changes in its size and shape, without moving away from the screening lining, thus preventing stray granules from slipping into the slot. The pretension of the sealing element permits a readjustment of the sealing element for accommodating wear on its sealing face. The sealing element can also be easily replaced.

Figure 2:
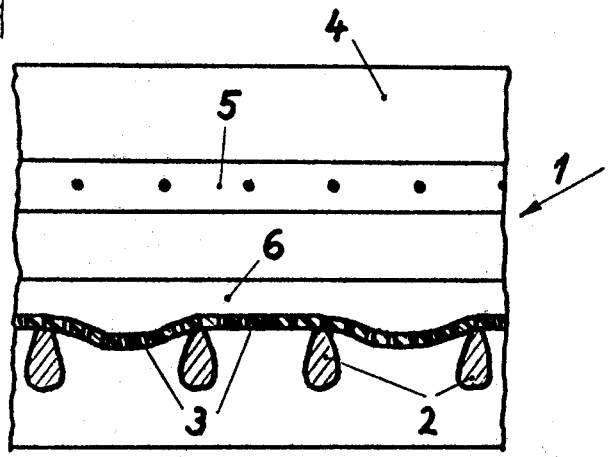
FIG. 2 is a fragmentarily-illustrated side view of the machine and sidewall sealing element shown in FIG. 1.

FIG. 2 is a side view of the same side sealing element 1. It can be seen how the sealing element 6 adjusts to the given shape of the screening lining or the screening mats 3, respectively.

Figure 3:
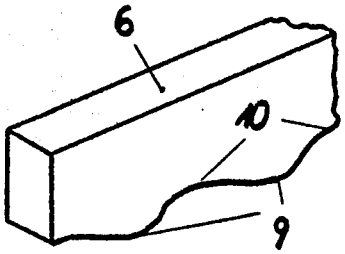
FIG. 3 is a fragmentarily-illustrated perspective view of the inventive sealing element.

FIG. 3 is a perspective view of a sealing element 6 for the side sealing of a screening machine, which operates in accordance with the "cocking lever shaft" principle. Sealing face 9 of the sealing element is sinusoidally-shaped in the longitudinal direction of the sealing element. In the installed condition, wave troughs or valleys 10 are in the range of cross rods 2. Sealing element 6 is not provided with any reinforcing elements and consists of polyethylene foam. The sealing element may be cut from a strand or a mat.

Figure 4:
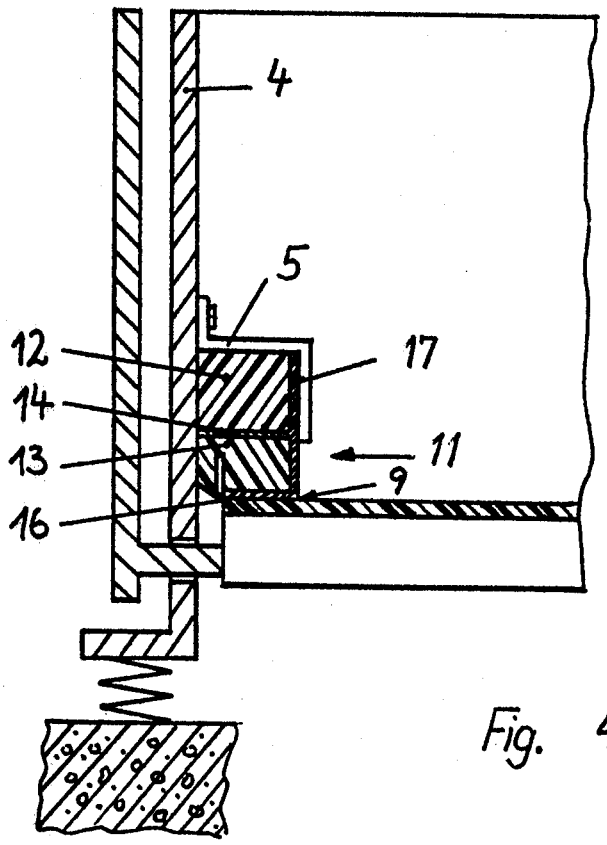
FIG. 4 is a fragmentarily-illustrated sectional view of a further inventive sidewall sealing element shown in an installed position.

FIG. 4 illustrates a further inventive sidewall sealing element, in sectional view and in its installed position. Again, this sealing element is installed in a screening machine which operates in accordance with the "cocking lever shaft" principle. For that purpose, a clamping bar 5 is rigidly installed at the sidewall 4 of the screening machine, which is z-shaped in its cross-section, for receiving sealing element 11; e.g., bar 5 may be rigidly secured to sidewall 4 by having a shank-like leg thereof secured to sidewall 4 by means of screws. In the groove or channel, which is formed between the bar 5 and sidewall 4, sealing element 11 is clamped therebetween, due to its inherent resiliency. The lower side of screening mat 3 is free from sealing elements, so that the screening mats 3 are not clamped at their edges, but are freely moveable. Sealing element 11 is provided with an upper clamping element 12 and a wear-layer 13, which are coupled with each other by means of a pore-closing intermediate layer 14, (e.g., a bonding agent). The lower sealing face of sealing element 11 as well as the inner, free lateral face of the sealing element facing the interior of the screening machine, are covered with a pore-closing layer 17. For this layer 17, as well as for the intermediate layer 14, the following materials are suitble: thermosetting plastics, for example, polychloroprene, polybutadiene, and also, crude rubber or rubber-hydrochloride.

A groove 16 is provided in the wear-layer of sealing element 11, which runs along the edge of screening mats 3. This prevents the eventually downwardly protruding, outer bevelled edge of the sealing face (due to wear of the inner portion of the sealing face), from bending the edge of the screening mats downwardly. In the shown embodiment, the width of sealing face 9 of sealing element 11 corresponds to the width of the opposing projection face on the edge of the screening lining or the screening mat, respectively, against which the sealing face will abut in its normal position. Sealing element 11 may be composed of individual segments, the length of the segments corresponding to a multiple of the width of a screening mat. Preferably, the screening machine has a left-and a right-side sealing element, which is mounted in the feeding direction of the sidewalls (i.e., parallel thereto).

While several embodiments of the present invention have been shown and described, it will be obvious to those persons of ordinary skill in the art, that many changes and modifications may be made thereunto, without departing from the spirit and scope of the invention.

What is claimed is:

1. In a screening machine, which operates in accordance with the "cocking lever shaft" principle, and which is of the type including a screening lining composed of a plurality of screening mats supported on spaced-apart, transversely-extending cross rods, a sidewall separated from the lining by a slot, and a side seal assembly which bridges the slot between the sidewall and the lining, the improvement comprising:

a sealing element for bridging and sealing the slot between the screening lining and the sidewall, said sealing element having a side facing said screening lining and said side thereof at least being covered with an elastic foam plastic, said sealing element having a generally rectangular cross-section and a wave-shaped sealing face facing the screening lining, said wave-shaped sealing face having wave-trough surface portions which are always positioned in the range of said cross-rods; and a support for said sealing element, said support being rigidly coupled to the sidewall of the machine and having a clamping bar which defines at least in part, a channel in which said sealing element is mounted, said channel being configured and dimensioned to permit said sealing element to be detachably clamped therein due to its inherent resiliency.

2. The side seal assembly according to claim 1, wherein the average installation height defined between said bar and said screening lining is between 3% and 20% less than the average installation height of the sealing element.

3. The side seal assembly according to claim 2, wherein said average installation height defined between said bar and said screening lining, is between 5% and 15% less than the average installation height of said sealing element.

4. The side seal assembly according to claim 6, wherein said sealing element consists completely of elastic foam plastic.

5. The side seal assembly according to claim 4, wherein said foam plastic is a polyethylene foam.

6. The side seal assembly according to claim 1, wherein said sealing face of said sealing element which faces the screening lining, runs in a longitudinal direction in a sinusoidal manner.

7. The side seal assembly according to claim 1, wherein said screening lining has a projection face lying adjacent to an edge of the screening lining, and wherein the width of said sealing face corresponds to the width of said projection face.

8. The side seal assembly according to claim 1, wherein said sealing element is provided with a groove which runs along an edge of said screening lining.

9. The side seal assembly according to claim 1, wherein said sealing element is made of foam plastic having closed pores.

10. The side seal assembly according to claim 1, wherein said sealing element is at least partially covered with a pore-closing layer.

11. The side seal assembly according to claim 1, wherein said sealing element is provided with a pore-closing intermediate layer.

* * * * *